US006041624A

United States Patent [19]

Pederzini

[11] Patent Number: 6,041,624

[45] Date of Patent: Mar. 28, 2000

[54] FABRIC AND METHOD FOR MANUFACTURING A HOLD-UP, CHAIN-STITCH, OR TULLE FABRIC

[76] Inventor: Cesare Pederzini, Via Beltramada, 10, 21019 Somma Lombardo (Prov. di Varese) -, Italy

[21] Appl. No.: 09/114,162

[22] Filed: Jul. 13, 1998

[30] Foreign Application Priority Data

Jul. 22, 1997 [IT] Italy ..... MI97A1730

[51] Int. Cl.[7] ..... D04B 23/06

[52] U.S. Cl. ..... 66/193

[58] Field of Search ..... 66/192, 193

[56] References Cited

U.S. PATENT DOCUMENTS

| | | | |
|---|---|---|---|
| 3,077,758 | 2/1963 | Siciliano | 66/192 |
| 3,255,614 | 6/1966 | Kemmnitz | 66/192 |
| 4,100,770 | 7/1978 | Titone | 66/193 |
| 4,331,135 | 5/1982 | Westip | 66/193 |
| 4,658,604 | 4/1987 | Wilson | 66/192 |
| 5,211,035 | 5/1993 | Hanson, II | 66/51 |
| 5,522,240 | 6/1996 | Wall et al. | 66/192 |

*Primary Examiner*—Andy Falik
*Attorney, Agent, or Firm*—Guido Modiano; Albert Josif

[57] ABSTRACT

A method (and resulting fabric) for manufacturing a chain-stitch, tulle or hold-up fabric, which comprises a first step of forming a chain-stitch fabric by inserting in the chain-stitches, during their formation, at least one first elastic yarn, and a second step of inserting, between the formation of the stitches, at least one second elastic yarn made of elastomer, which is kept floating in segments for a preset number of stitches on the side of the fabric meant to be directed towards a user's skin.

8 Claims, 3 Drawing Sheets

FABRIC AND METHOD FOR MANUFACTURING A HOLD-UP, CHAIN-STITCH, OR TULLE FABRIC

BACKGROUND OF THE INVENTION

The present invention relates to a method for manufacturing a hold-up chain-stitch, tulle or similar fabric and to a fabric obtained with the method, meant to be used particularly in the field of corsetry.

Fabrics are known, particularly for producing items of corsetry, which have a hold-up effect, i.e., are capable of applying to the user's body tractions in various directions such as to shape the user's body in the selected regions.

The hold-up effect is currently achieved by applying a layer of liquid silicone on an elastic fabric which is produced and finished beforehand. Polymerization of the silicone with formic acid is then produced, followed by washing and by final drying of the resulting product in an oven at 180° C.

In the more specific case of the production of bands of lace intended for producing hold-up brassieres, hold-up stockings and elastic bands for waistbands and leg borders, according to this production method it is necessary to form the bands of lace, perform finishing, and then subject the bands of lace to the silicone coating treatment. This operation is usually performed by specialized laboratories which are different from those that produce the lace bands.

Due to this fact, long production times and high costs are observed in the manufacture of these items.

Moreover, the application of silicone to obtain the hold-up effect can cause size alterations to the treated fabrics; in particular, it can reduce the width of the lace bands.

Silicone is generally applied in strips which are usually 5 mm wide and located 5 cm apart; therefore its application to the lace band is uneven.

Another drawback that arises from this production method is that it provides a product which cannot be tolerated easily by the user, since contact of the silicone on the skin can be uncomfortable and can produce skin irritations in the regions where it adheres, at which regions, skin transpiration is not allowed.

Another drawback of this production method is the fact that the silicone bands cannot be easily dyed in the same color as the fabric.

SUMMARY OF THE INVENTION

The aim of the present invention is to solve the above problems by providing a method which allows to produce a chain-stitch, tulle or similar fabric with an excellent hold-up effect at a low cost and with reduced production times with respect to conventional production methods.

Within the scope of this aim, an object of the present invention is to provide a method which allows to obtain a hold-up fabric of superior quality which can be better tolerated and is more comfortable to use.

Another object of the present invention is to provide a method which allows to provide fabrics having a hold-up effect all along their extension which, with current production methods, cannot be produced reasonably because it is impossible to achieve polymerization and drying over the entire width of the band of fabric.

Another object of the present invention is to provide a hold-up fabric in which the material used to obtain the hold-up effect can be dyed in the same color as the fabric in a satisfactory manner and without requiring additional processes.

This aim, these objects and others which will become apparent hereinafter are achieved by a method for manufacturing a chain-stitch, tulle or similar hold-up fabric which consists in forming a chain-stitch fabric by inserting in stitches of the chain-stitch, tulle or similar during their formation, at least one first elastic yarn; characterized in that at least one second elastic yarn made of natural elastomer is inserted between the stitches during their formation and in that said second elastic yarn is kept floating in segments for a preset number of stitches on the side of the fabric meant to be directed towards the user's skin.

The hold-up fabric obtained with the method according to the invention and meant to be used particularly in the field of corsetry comprises chain-stitches, tulle or similar in which a first elastic yarn is inserted, characterized in that it comprises at least one second elastic yarn made of natural elastomer which is inserted in stitches of the chain-stitches, tulle or similar and protrudes in segments, for a preset number of stitches, on a side of the fabric that is provided to be directed towards the user's skin.

BRIEF DESCRIPTION OF THE DRAWINGS

Further characteristics and advantages of the present invention will become apparent from the following detailed description of a preferred but not exclusive embodiment of the method according to the invention, illustrated only by way of non-limitative example in the accompanying drawings, wherein.

DESCRIPTION OF THE PREFERRED EMBODIMENTS

Figure 1:
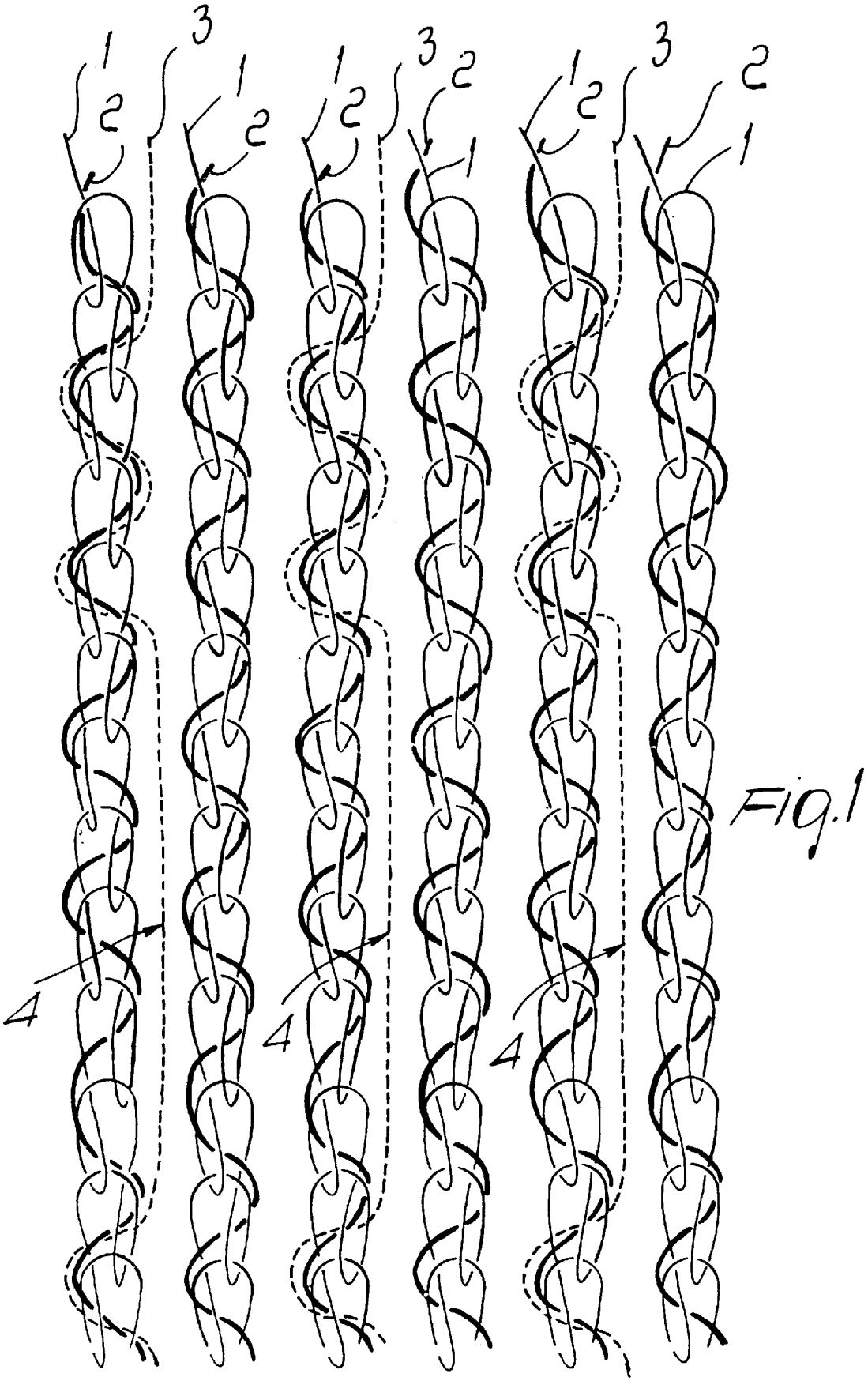
FIGS. 1 to 3 are schematic views of three hold-up fabric configurations obtained with the method according to the invention.
Figure 2:
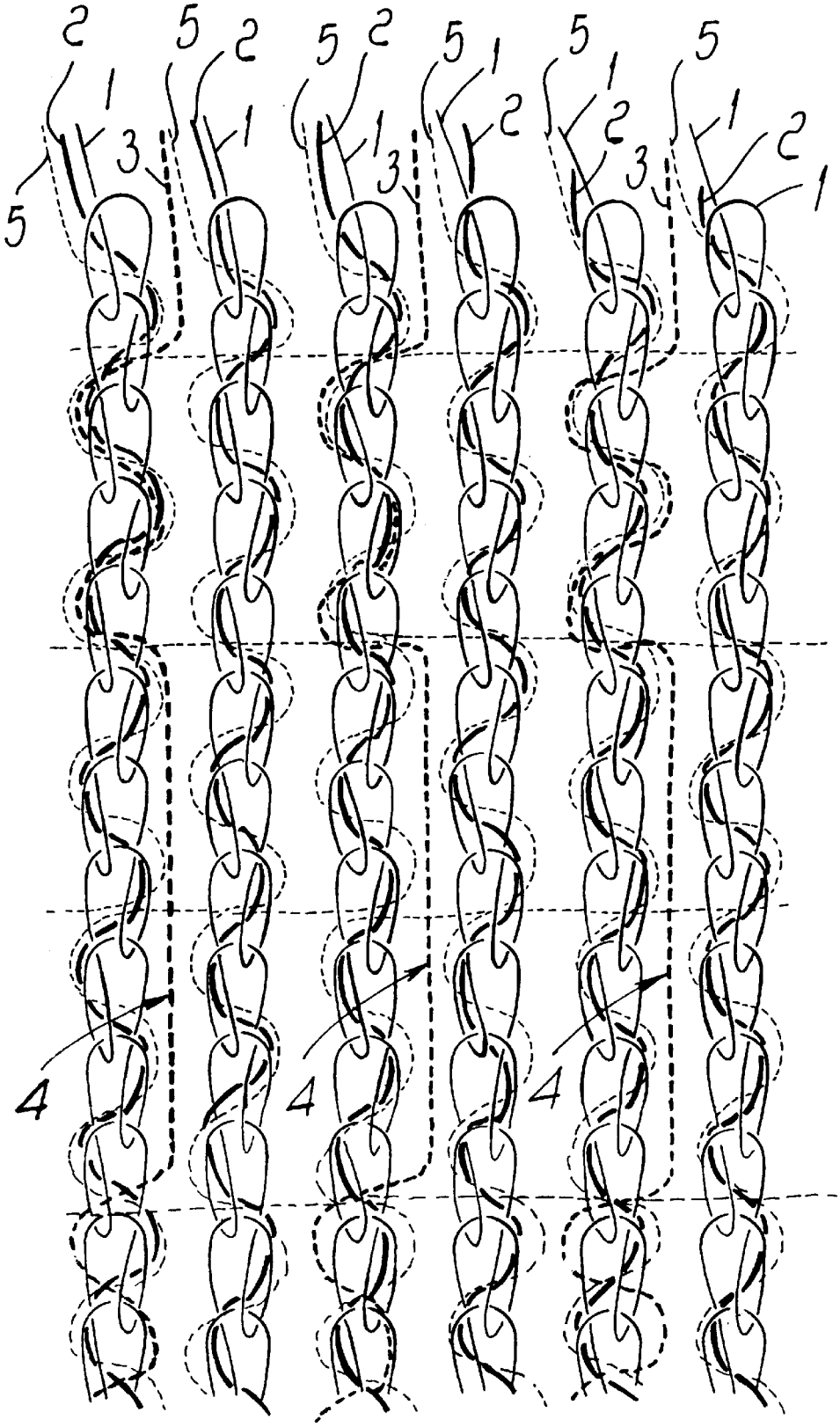
Figure 3:
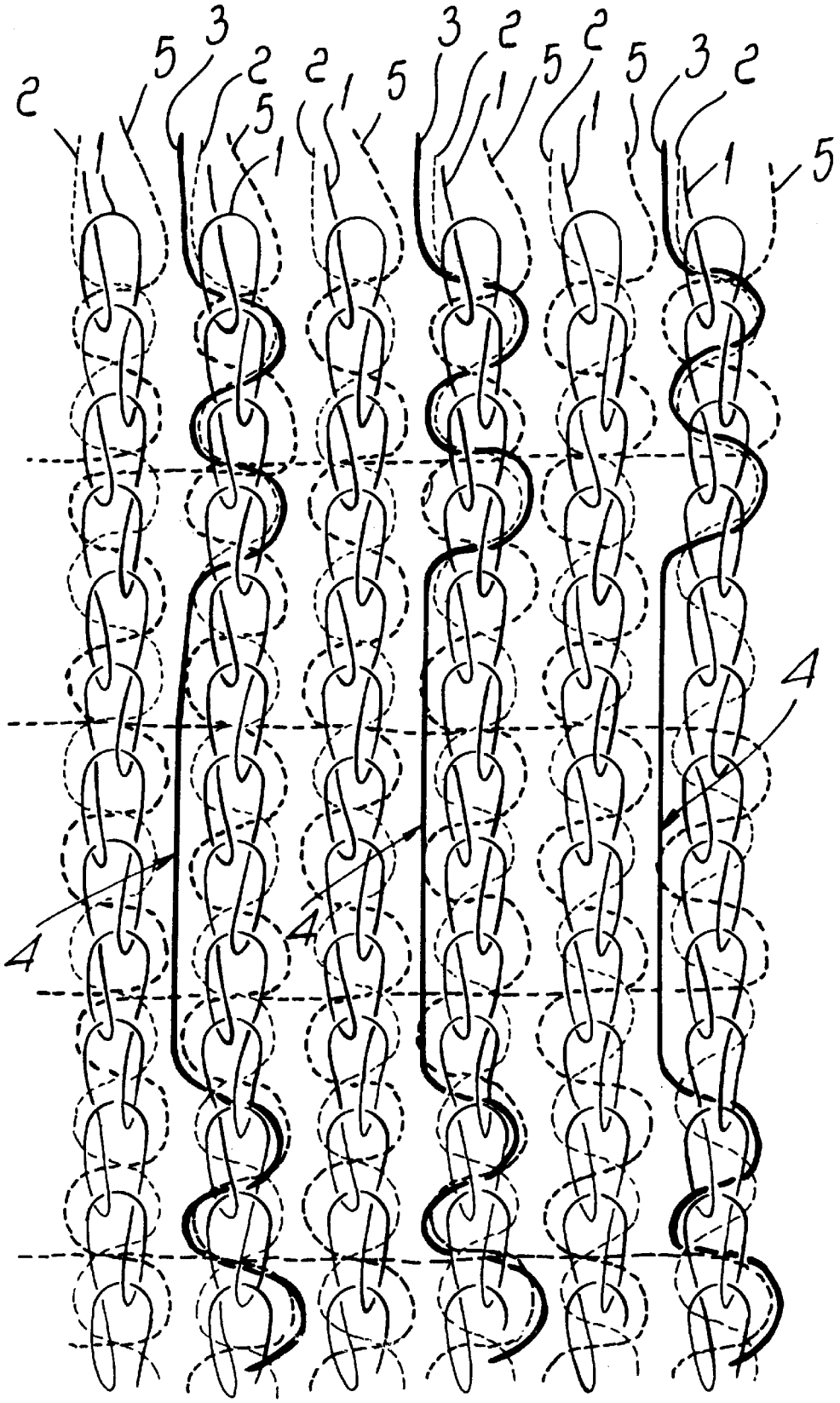

The method according to the invention is intended to be performed preferably on warp-knitting needle looms forming chain-stitch, tulle or similar fabrics.

More specifically, the method according to the present invention can preferably be performed by means of looms of the so-called "multiple beam" type operated mechanically or electronically and other possible variations including conventional Jacquard Raschel looms, Jacquardtronic looms and Textronic looms.

In practice, with the method according to the invention an elastic fabric is formed in a per se known manner by forming a chain-stitch, tulle or similar fabric, for example by using a yarn 1 to form the chain-stitches, tulle or similar and at least one first elastic yarn 2 which is inserted in a per se known manner between stitches of the chain-stitches, tulle or similar so as to obtain an elastic fabric.

According to the invention, during the formation of the chain-stitches, tulle or similar formed with the yarn 1, at least one second elastic yarn 3 is inserted between said chain-stitches, tulle or similar together with the elastic yarn 2; said second elastic yarn 3 is made of natural elastomer and is kept floating in segments 4 which cover a preset number of stitches formed with the yarn 1.

The segments 4 protrude from the side of the fabric that is meant to be directed towards the skin of the user and are not covered by the other yarns used to form the fabric.

In practice, in a loom of the so-called "multiple-beam" type, the last set of pattern beams is assigned to a single ground reed to feed the second elastic yarn 3, which is added to the one that is already present on the loom to weave the elastic fabric, or to feed the first elastic yarn 2. In practice, two reeds of the "ground" type are present in the last two positions of the loom. The ground reed in the last-but-one position is threaded with the elastic yarn 2 and the last reed is threaded with the elastic yarn 3 made of natural elastomer, preferably of the type known commercially by the name "Clear", which can be dyed better and has a count which is higher on the average.

The threading of the second elastic yarn 3 can vary according to the requirements from "full" to "one full, one empty", in strips in the selected regions of the fabric, for example on the borders of the band of fabric or in another manner.

The last reed, which carries the second elastic yarn 3 made of natural elastomer and which incidentally is the first reed on the side technically known as the "front" of the loom, operates as follows: it crosses the needle for one or more stitches, preferably two or four, so as to insert the second elastic yarn 3 through the ground stitches formed with the yarn 1, in a manner which is similar to what is done for the first elastic yarn 2, so as to firmly couple the second elastic yarn 3 to the ground of the fabric, and then keeps the elastic yarn 3 motionless between the needles for a preset number of stitches.

Over the entire segment in which the elastic yarn 3 remains motionless between one needle and the next, it is not covered by any other yarn and thus remains exposed on one side of the fabric, even if it is coupled to the rest of the fabric.

The segments 4 of the elastic yarn 3 adhere closely, despite not being covered by other yarns, to the ground of the fabric and give the fabric the required grip on the skin in a manner which can be adjusted from weak to strong, depending on the number of inserted elastic threads.

The accompanying drawings illustrate, merely by way of non-limitative example, a conventional elastic ground formed with a Raschel lace loom. The reference numeral 1 designates the yarn for forming the chain stitches; the reference numeral 2 designates the elastic yarn that is inserted in the chain-stitches in a per se known manner to obtain a stretch fabric; the reference numeral 3 designates the elastic yarn made of natural elastomer for obtaining the hold-up effect according to the present process; and the reference numeral 5 designates an additional yarn which is carried by a ground beam of the loom to mutually connect the various chain-stitches.

In practice, the method according to the invention produces a chain-stitch, tulle or similar fabric, particularly a lace fabric meant to be used to manufacture corsetry items, which is composed of chain-stitches, tulle or similar in which a first elastic yarn 2 and a second elastic yarn 3 made of natural elastomer are inserted; said natural-elastomer yarn too is inserted in the chain-stitches, tulle or similar and protrudes in segments, for a preset number of stitches, on the side of the fabric that is meant to be directed towards the user's skin, thus obtaining regions where the fabric adheres more strongly to the user's skin and therefore obtaining the intended hold-up effect.

In practice, it has been observed that the method according to the invention fully achieves the intended aim and objects, since it allows to produce fabrics having a hold-up effect without requiring any additional operation to apply silicone bands.

Another advantage of the method according to the invention is that it can be performed directly in laboratories for producing chain-stitch, tulle or similar fabrics without requiring the intervention of specialized laboratories to apply the silicone strips.

Another advantage of the method according to the invention is that it allows to manufacture hold-up fabrics which can be better tolerated and are more comfortable to wear.

The method thus conceived is susceptible of numerous modifications and variations, all of which are within the scope of the inventive concept; all the details may also be replaced with other technically equivalent elements.

The disclosures in Italian Patent Application No. MI97A001730 from which this application claims priority are incorporated herein by reference.

In practice, the materials employed may be any according to requirements.

What is claimed is:

1. A method for manufacturing a hold-up fabric, comprising the steps of: forming a chain-stitch fabric by inserting in stitches of the fabric, during formation thereof, at least one first elastic yarn, said first elastic yarn being a bare yarn and being firmly coupled to the stitches of the fabric;

inserting at least one second elastic yarn made of an elastomer between the stitches of the chain-stitch fabric during formation thereof and keeping floating said second elastic yarn, in segments, for a preset number of stitches, on a side of the fabric provided for being directed towards a user's skin.

2. The method of claim 1, further comprising the step of inserting an additional yarn to mutually connect the stitches of the fabric.

3. The method according to claim 1, comprising making said second elastic yarn of an elastomer which is dyeable.

4. A hold-up fabric, for manufacturing items of corsetry, comprising:

chain-stitches forming a fabric;

a first elastic bare yarn inserted in said chain-stitches so as to be firmly coupled to said stitches; and at least one second elastic yarn made of an elastomer, said second elastic yarn being inserted in the chain-stitches of the fabric to protrude in segments, for a preset number of stitches, on a side of the fabric that is provided to be directed towards a user's skin.

5. The hold-up fabric according to claim 4, wherein said second elastic yarn has a higher count than said first elastic yarn.

6. The hold-up fabric according to claim 4, wherein an additional yarn is inserted to mutually connect the chain-stitches.

7. A method for manufacturing a hold-up fabric, comprising the steps of:

forming a chain-stitch fabric by inserting in stitches of the fabric, during formation thereof, at least one first elastic yarn, said first elastic yarn being a bare yarn and being firmly coupled to the stitches of the fabric;

inserting at least one second elastic yarn made of an elastomer between the stitches of the chain-stitch fabric during formation thereof and keeping floating said second elastic yarn, in segments, for a preset number of stitches, on a side of the fabric provided for being directed towards a user's skin;

the second elastic yarn being firmly coupled to the stitches of the fabric in portions of the fabric different from said segments in which the second elastic yarn is kept floating; and inserting an additional yarn to mutually connect the chain-stitches.

8. A hold-up fabric, for manufacturing items of corsetry, comprising:

chain-stitches forming a fabric;

a first elastic bare yarn inserted in said chain-stitches so as to be firmly coupled to said stitches;

at least one second elastic yarn made of an elastomer, said second elastic yarn being inserted in the chain-stitches of the fabric to protrude in segments, for a preset number of stitches, on a side of the fabric that is provided to be directed towards a user's skin; and an additional yarn inserted to mutually connect the chain-stitches.

* * * * *